US009320357B1

(12) United States Patent
Tian

(10) Patent No.: US 9,320,357 B1
(45) Date of Patent: Apr. 26, 2016

(54) SYSTEM AND METHOD FOR SINGLE PERSON MOUNTING OF WALL-MOUNTED CABINETS OR SHELVES

(71) Applicant: Jiaxing Tian, Sunnyvale, CA (US)

(72) Inventor: Jiaxing Tian, Sunnyvale, CA (US)

( * ) Notice: Subject to any disclaimer, the term of this patent is extended or adjusted under 35 U.S.C. 154(b) by 0 days.

(21) Appl. No.: 14/849,098

(22) Filed: Sep. 9, 2015

(51) Int. Cl.
*A47B 95/00* (2006.01)
*E04F 19/08* (2006.01)
*A47B 77/00* (2006.01)

(52) U.S. Cl.
CPC ..... *A47B 95/008* (2013.01); *A47B 77/00* (2013.01); *E04F 19/08* (2013.01)

(58) Field of Classification Search
CPC ..... B21D 43/003; B21D 43/10; A47B 27/00
See application file for complete search history.

(56) References Cited

U.S. PATENT DOCUMENTS

| | | | | |
|---|---|---|---|---|
| 1,916,509 | A | 7/1933 | Hammer | |
| 4,032,130 | A * | 6/1977 | Huntley | B25B 5/142 269/254 R |
| 4,527,784 | A * | 7/1985 | Schwab | B25B 1/205 269/109 |
| 4,610,489 | A | 9/1986 | Dibert, Jr. | |
| 5,624,168 | A | 4/1997 | Licciardello, Sr. | |
| 6,764,434 | B1 * | 7/2004 | Volk | B23Q 1/032 144/48.1 |
| 2007/0007702 | A1 * | 1/2007 | Brandl | B25B 5/003 269/37 |
| 2014/0252711 | A1 * | 9/2014 | Tropea | B25B 1/06 269/90 |
| 2015/0047198 | A1 | 2/2015 | Bruin-Slot | |

* cited by examiner

*Primary Examiner* — Lee D Wilson
(74) *Attorney, Agent, or Firm* — Robert Brownstein

(57) ABSTRACT

The system and method invention herein disclosed and claimed is a system and method for single-person mounting of wall-mounted cabinets or shelves.

7 Claims, 3 Drawing Sheets

SYSTEM AND METHOD FOR SINGLE PERSON MOUNTING OF WALL-MOUNTED CABINETS OR SHELVES

TECHNICAL FIELD

This invention is associated with construction tools and practices.

BACKGROUND OF THE INVENTION

During new home or building construction, or home or building renovation, it is common to replace large wall-mounted objects such as cabinets and shelves. Typically, doing so requires at least two people. One or more hold the object to be mounted against the wall while another person positions the object, makes sure it is level, and then begins securing it to the wall.

Clearly, this practice ordinarily involves multiple people and multiple hourly costs because these objects, such as cabinets or shelves, can be large, heavy objects.

A system and method that could allow a single person to successfully mount such objects would free up other people to do other tasks concurrently. As a result, overall construction labor costs could be reduced.

BRIEF SUMMARY OF THE INVENTION

The invention herein disclosed and claimed is a system and method for enabling a single person to properly mount wall-mounted objects, such as a cabinets or shelves.

The system comprises a set of interconnecting components that enable one person to create an extendable wall mounting platform upon which a wall-mounted object can be placed, leveled, and secured.

The method comprises mounting the extendable wall mounting platform, placing the object to be mounted on said platform and positioning it flush with the wall to which it will be mounted. Using the system's leveling adjustments, the person is able to level the object. Then, as the object sits on the platform, the person can secure the object using suitable wall-mounting techniques.

BRIEF DESCRIPTIONS OF THE DRAWINGS

DETAILED DESCRIPTION OF THE INVENTION

Mounting wall-mounted objects can often be a multi-person endeavor where one or more people hold the object against a wall while another person adjusts its orientation to make it level, and then perhaps another person secures the object to the wall using appropriate mounting techniques.

The invention is a system and method that enables a single person to mount a wall-mounted object. As such, it enables other people to do other tasks concurrently and can reduce the overall cost of construction labor.

Figure 1:
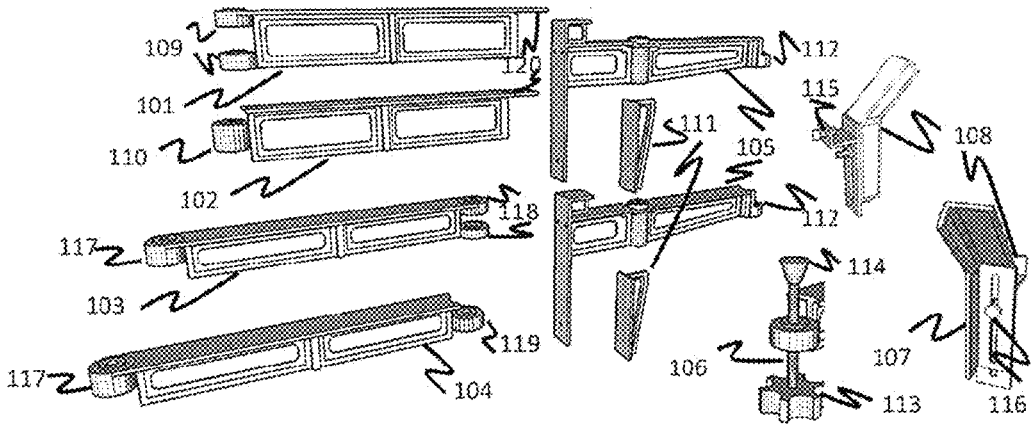
FIG. 1 depicts the constituent components of one embodiment of the system.

As shown in FIG. 1, the system is comprised of interconnecting components which can be configured to accommodate a wall-mounted object's horizontal dimensions and weight. A wall-mounting component 105 comprises an essentially rectangular vertically oriented portion that is operative to mount to the wall, vertically oriented, and secured to the wall by screws passing through the wall-mounting component's screw holes and into a wooden wall stud. The wall-mounting component also comprises a horizontal portion that joins the vertical portion at one end of the horizontal portion, and has a fixture for connecting interconnecting components 112 at the opposite end. Between the two ends of said horizontal portion is a vertically oriented threaded fixture to which other interconnecting components may be attached and through which a leveling screw component 106 can be threaded. Said leveling screw component comprises a leveling tip 114 at one end, and a detachable knurled knob 113 at the opposite end. The wall-mounting component can be reinforced to support greater weight by augmenting it with a reinforcing component 111 that is attached to the wall-mounting component's rectangular vertically oriented portion such that it provides additional support to the right angle interface between said vertical portion and said horizontal portion. Two rearward horizontal components 101 and 102 are rectangular structures of the same horizontal and vertical dimensions. On one end of each rearward horizontal component is an extended portion having a vertically oriented hole 120. These ends are structured to sit atop the vertically oriented threading fixture 112 to provide an interconnection to said wall-mounting component. At the other end of one rearward component 101 is a pair of threaded fixtures 109, one displaced vertically from the other and spaced such that it provides an interface for the other rearward component 102. Component 102 has a single threaded fixture that fits snugly between the threaded fixtures of 101 while allowing rotation. Thus, a component 101 and a component 102 can be joined by interconnecting their ends 109 and 110 respectively. Two forward horizontal components 103 and 104 have identical horizontal and vertical dimensions. On one end of both 103 and 104 is a threaded fixture 117. On the opposite end of 103 is a pair of threaded fixtures, vertically separated 119. On the end of 104 is a single threaded fixture 119 that can fit snugly between the fixtures 118. As with the two rearward horizontal components, the two forward horizontal components can be joined by interfacing them at the threaded fixtures 118 and 119. A fixed-angle component 108 is operative to connect to the horizontal lip of the upper face of a wall-mounted object and provide a precise 45 degree angle between the top edge of said face and a ceiling. Said fixed-angle component mounts to said face using the bracket and screw 115. It is then adjusted to be flush with said ceiling by loosening screw 116, extending or retracting the angled portion 107 then tightening screw 116.

Figure 2:
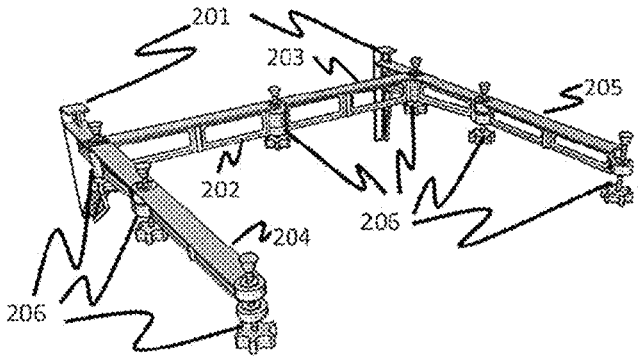
FIG. 2 depicts an embodiment of the system in which some constituent components are configured and joined.

FIG. 2 illustrates how in one embodiment of said system said components can be interconnected to form a mounting frame. One of the wall-mounting components 201 are connected to one end of rearward component 202 and the other wall-mounting component is connected to one end of rearward component 203. The threaded fixtures of rearward components 202 and 203 are fitted together and joined using screw 206. A forward component 204 is joined to one of the wall-mounting components 201 by interfacing its threaded fixture with that of the wall-mounting component's threaded fixture and then joining them with screw 206. Similarly, the forward component 205 is interfaced to the other wall-mounting component by interfacing their respective threaded fixtures and joining them with screw 206. Note that screws 206 are also included at the ends of the forward horizontal components. The configuration thus shown will accommodate an object whose depth is equal to or greater than the lengths of the wall-mounting components' horizontal portions plus the horizontal lengths of said forward components.

Figure 3:
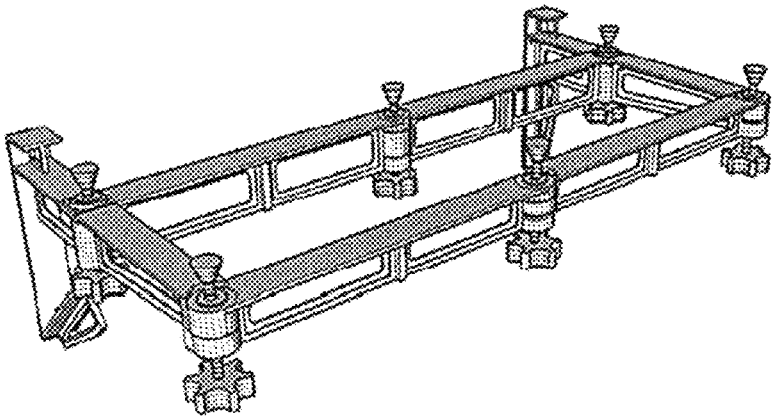
FIG. 3 depicts another embodiment of the system in which some constituent components are configured and joined.

In FIG. 3, the forward horizontal components attached to the two wall-mounting components are rotated (not shown) with the threaded fixtures as the center of rotation such that the respective ends of said forward horizontal components meet and snugly interface at the threaded fixtures on their respective opposite ends. The interface is then joined by using a leveling screw component such as 206 in FIG. 2.

The interconnecting components of the disclosed and claimed system enable one to configure a mounting platform that can be extended both horizontally along the wall and horizontally away from the wall by using the appropriate rearward and forward horizontal components.

The interconnecting components can be made from a variety of materials but must have sufficient rigidity and strength to support the intended wall-mounted object loads. The dimensions of the interconnecting components may also vary depending upon the intended wall-mounted object loads.

Some exemplary dimensions for the wall-hanging component are vertical portion height of 6 inches, width of 1 inch, horizontal portion length of 9.5 inches, with vertical threaded fixture located 2.5 inches from the vertical portion and 7 inches from the threaded fixture at the end. The thickness and type of material would be chosen to accommodate the worst case wall-mounted object load. This, again, is exemplary and should not be read as limiting the dimensions of said interconnecting components.

The ability of the system to be extended, of course, requires that the interconnecting rearward and forward horizontal components have consistent horizontal dimensions. Again, material and thicknesses depend upon the worst-case loads to be supported during mounting.

Figure 4:
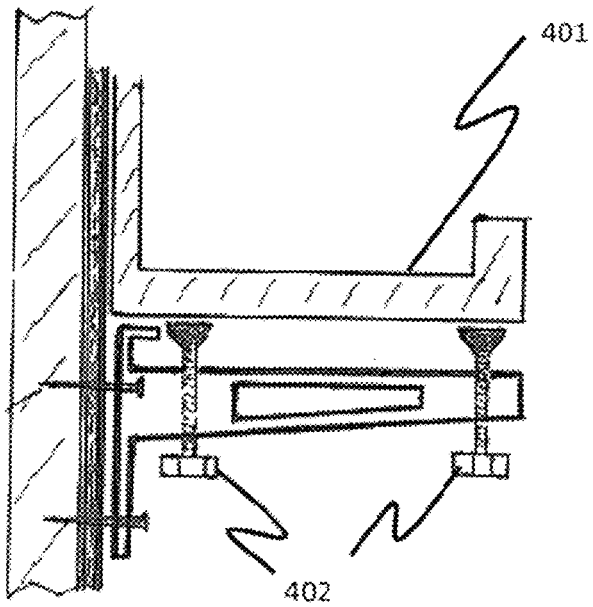
FIG. 4 illustrates a side view of the system being used to level and mount a wall-mounted object.
Figure 5:
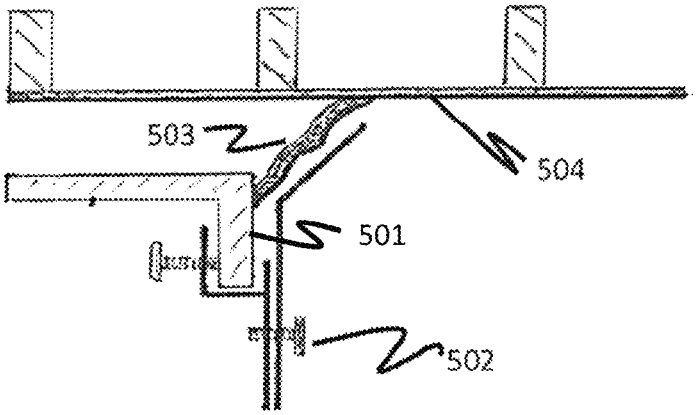
FIG. 5 illustrates another system embodiment attached to the upper part of a wall-mounted object's face providing an exact angle between said top portion of said object and a ceiling thus providing a mounting platform for any crown molding strips to be applied.

The method for single-person mounting using said system comprises configuring a mounting frame based on the dimensions of the object to be mounted. The frame is then mounted to the wall creating an essentially horizontal plane surface. The wall-mounting components are secured to the wall by being affixed with screws that extend through the screw holes in the vertical portions and into wooden studs behind the wall. Once so mounted, the user has a sturdy, essentially horizontal platform upon which the object to be mounted, FIG. 4 401, can be placed and supported. Once placed in the desired position, a user may adjust the object's orientation to make it level by using a level indicating device and adjusting the leveling screws, 402. One can adjust for level in a line parallel to the wall and perpendicular to the wall. When leveling adjustments have been made, the object can then be securely mounted to the wall using well-known wall mounting techniques.

Where the object to be mounted is near a ceiling, it is often the case that a strip of material, such as a crown molding, is used to enclose the space between the top surface of the object and the ceiling. In such cases, it is common for the strip of material to be angled such that it makes a 45 degree angle with the top front edge of the wall-mounted object and the ceiling. To ensure that the angle is precise, and to allow one person to install the strip of material, the component 108 from FIG. 1 can be used by attaching it to a horizontal lip of the objects face, FIG. 5 501, using the bracket-and-screw fixtures, 502, and then adjusting the fixed-angle portion FIG. 1 107 until it is flush with the ceiling 504. This will then provide a platform for placing and installing the strip of material 503 while ensuring that an essentially precise 45 degree angle is preserved.

Note that the system is operative to be temporarily mounted to a wall, below the position of the bottom of a wall-mounted object, and becomes a sturdy, temporary platform for positioning, leveling and installing said wall-mounted object. Once the wall mounted object is installed, the system is removed and any holes are filled and touched up.

The system should be viewed as a tool rather than a mounting structure. It is meant to be used and reused. Its interconnecting components enable one to create a temporary platform with whatever dimensions are required. It enables single-person installation of wall-mounted objects, so that an existing crew can finish a job sooner; or fewer people are required to finish a job on time. In either case, it can reduce construction costs.

What is claimed is:

1. A system comprising:

interconnecting structural components;

said interconnecting structural components operative to enable variable configurations of said components so as to construct essentially rectangular, horizontally oriented platforms with incrementally varying dimensions;

a wall-mounting component comprising a vertical portion and a horizontal portion;

said wall-mounting components further comprising screw holes in said vertical portion;

a rearward horizontal component comprising threaded interconnection fixtures at each end;

a forward horizontal component comprising threaded interconnection fixtures at each end;

a level-adjusting threaded shaft comprising a conical shaped portion whose axis is in line with that of said threaded shaft and whose larger base is at the end of said threaded shaft;

said threaded shaft operative to join said threaded interconnection fixtures at said each end of said rearward horizontal components, and to join said threaded interconnection fixtures at said each end of said forward horizontal components.

2. A system as in claim 1 further comprising:

a reinforcing component comprising a right-triangular structure operative to reinforce the load bearing characteristics of the wall-mounting component;

said reinforcing component opposing any angular stress on said wall-mounting component at the points where said vertical portion joins said horizontal portion.

3. A system as in claim 1 further comprising:

a fixed-angle component comprising a bracket-and-screw portion and a fixed-angle portion;

said bracket-and-screw portion operative to attach to a vertically oriented lip structure on the face portion of an object to be mounted;

said fixed-angle portion operative to support a fixed 45 degree angle with respect to the top edge of said object to be mounted and an essentially horizontal surface to which the edge of said fixed-angle portion is flush.

4. A system as in claim 1 further comprising:

said threaded interconnection fixtures at each end of said wall-mounting components operative to allow said interconnection fixtures at the end of said forward horizontal components to interface snugly while enabling said forward horizontal components to rotate with respect to said wall-mounting components;

said threaded interconnection fixtures at each end of said wall-mounting components operative to allow said interconnection fixtures at the end of said forward horizontal components to be joined by said level-adjusting threaded shaft, where said level-adjusting threaded shaft is the axis of rotation of said forward horizontal components with respect to said wall-mounting components.

5. A system as in claim 1 further comprising:

said threaded interconnection fixtures at said ends of said forward horizontal component operative to allow said interconnection fixtures of said ends of another forward horizontal component to interface snugly while enabling said forward horizontal components to rotate with respect to one another;

said threaded interconnection fixtures at said ends of said forward horizontal component operative to allow said interconnection fixtures of said ends of another forward horizontal component to be joined by said level-adjusting threaded shaft, where said level-adjusting threaded shaft is the said axis of rotation of said forward horizontal components with respect to said another forward horizontal component.

6. A method comprising:

configuring said interconnecting structural components of said system to construct said essentially rectangular, horizontally oriented platform with desired dimensions;

mounting said wall-mounting components of said essentially rectangular, horizontally oriented platform to a wall by locating said wall-mounting components adjacent to wall studs and attaching them to said wall with screws extending through said screw holes in said vertical portion and into said wall studs;

placing object to be mounted into position on said essentially rectangular, horizontally oriented platform;

leveling said object to be mounted by adjusting said level-adjusting threaded shafts until said object is level both parallel to said wall and perpendicular to said wall;

securing said object to be mounted to said wall;

removing said screws attaching said wall-mounting components and removing said essentially rectangular, horizontally oriented platform.

7. A method as in claim 5 further comprising:

attaching said fixed-angle component to said vertically oriented lip structure on said face of said object to be mounted by tightening said bracket-and-screw portion;

extending said fixed-angle portion until it is flush with a ceiling;

securing said fixed-angle portion in position;

using said fixed-angle portion to align a crown molding strip such that it forms a fixed-angle with the top edge of said object to mounted and said ceiling.

* * * * *